United States Patent [19]

Miller et al.

[11] Patent Number: 5,053,583

[45] Date of Patent: Oct. 1, 1991

[54] BUNDLED HYBRID RIBBON ELECTRICAL CABLE

[75] Inventors: Vernon R. Miller, Atlanta; Lincoln E. Roberts, Decatur, both of Ga.

[73] Assignee: AMP Incorporated, Harrisburg, Pa.

[21] Appl. No.: 298,528

[22] Filed: Jan. 18, 1989

[51] Int. Cl.[5] ..... H01B 11/00

[52] U.S. Cl. ..... 174/36; 174/32; 174/115; 174/117 F

[58] Field of Search ..... 174/32, 36, 115, 117 R, 174/117 F

[56] References Cited

U.S. PATENT DOCUMENTS

| | | | |
|---|---|---|---|
| 2,526,942 | 10/1950 | Fuchs | 174/36 |
| 2,623,093 | 12/1952 | Smith | 174/115 |
| 3,328,510 | 6/1967 | White | 174/41 |
| 3,549,788 | 12/1970 | Apen | 174/115 X |
| 3,588,336 | 6/1971 | Scher | 174/115 X |
| 4,030,801 | 6/1977 | Bunnell | 439/540 |
| 4,110,554 | 8/1978 | Moore et al. | 174/115 X |
| 4,149,026 | 4/1979 | Fritz et al. | 174/32 |
| 4,217,155 | 8/1980 | Fritz et al. | 156/55 |
| 4,240,688 | 12/1980 | Sotolongo | 439/535 |
| 4,319,075 | 3/1982 | Willette | 174/117 FF |
| 4,468,089 | 8/1984 | Brorein | 174/36 X |
| 4,533,790 | 8/1985 | Johnston et al. | 174/115 |
| 4,533,790 | 8/1985 | Johnston et al. | 174/36 |
| 4,649,228 | 3/1987 | Suzuki | 174/36 |
| 4,719,319 | 1/1988 | Tighe, Jr. | 174/103 |
| 4,758,536 | 7/1988 | Miller et al. | 439/138 |

FOREIGN PATENT DOCUMENTS

| | | | |
|---|---|---|---|
| 213616 | 3/1987 | European Pat. Off. | 174/117 F |
| 2900302 | 7/1980 | Fed. Rep. of Germany | 174/115 |
| 3141636 | 5/1983 | Fed. Rep. of Germany . | |
| 670831 | 10/1964 | Italy | 174/115 |
| 646672 | 11/1950 | United Kingdom | 174/36 |

OTHER PUBLICATIONS

"Tri/Con TM A Total Wiring System" article.

*Primary Examiner*—Morris H. Nimmo

*Attorney, Agent, or Firm*—Robert W. Pitts; William B. Noll

[57] ABSTRACT

An electrical transmission cable incorporating coaxial cables, power supply cables, data conductors and telephone conductors suitable for use in residential wiring is disclosed. Cable comprises a bundle configuration in which coaxial conductors are disposed in a center of a round bundle between data and telephone conductors to reduce the continuation of signals in the data and telephone conductors.

9 Claims, 5 Drawing Sheets

Fig. 2A
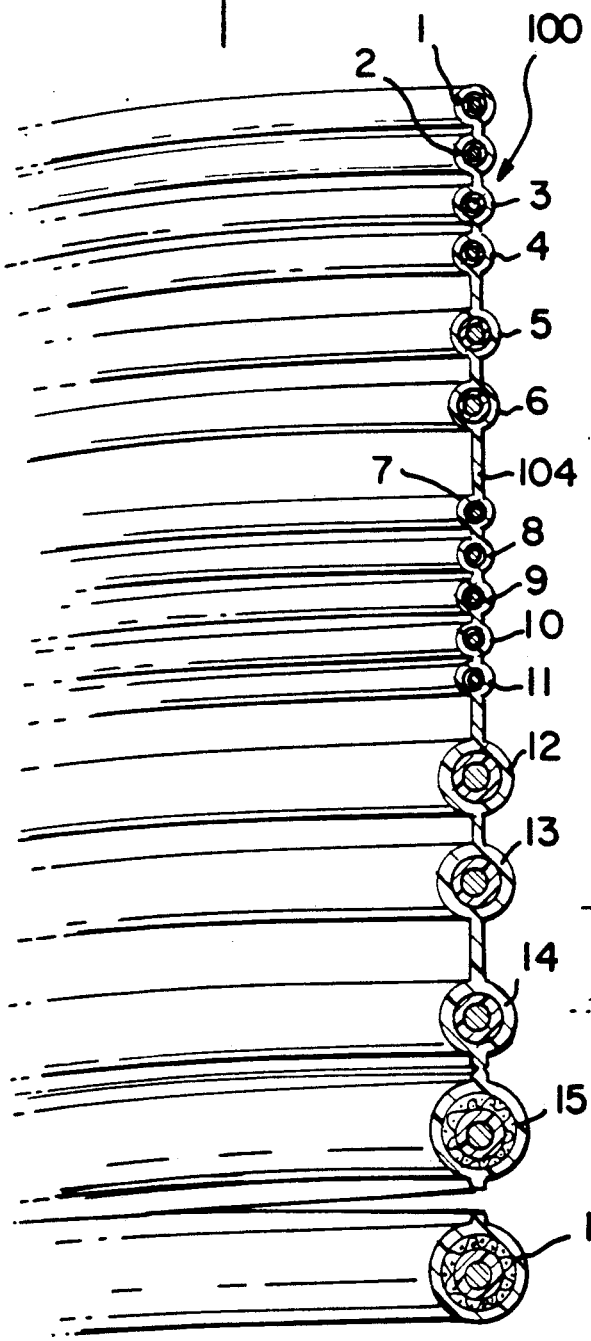
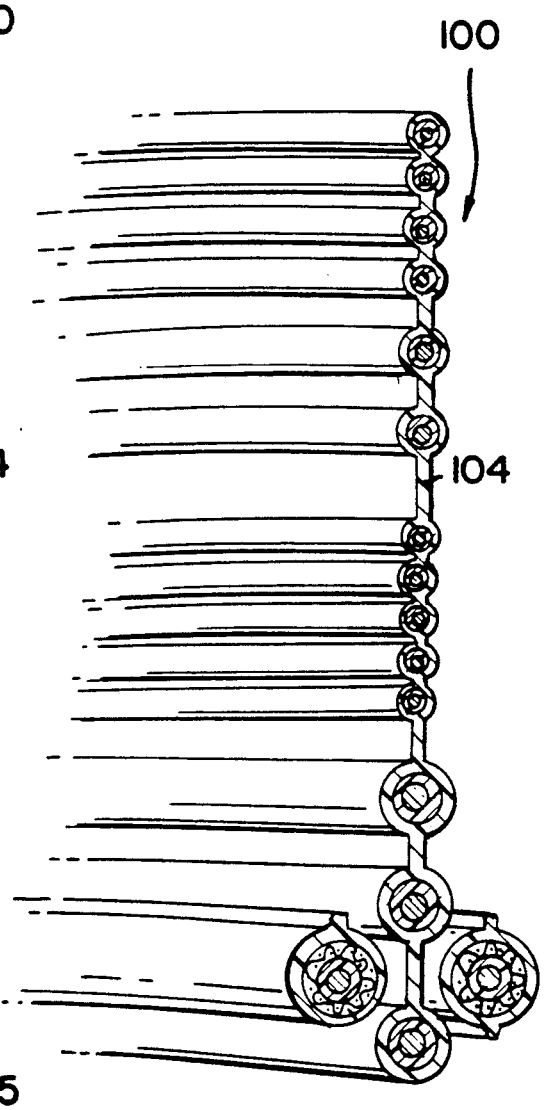
Fig. 2B

BUNDLED HYBRID RIBBON ELECTRICAL CABLE

BACKGROUND OF THE INVENTION

1. Field of the Invention

This invention relates to an electrical cable suitable for distributing an alternating current and signals and more specifically relates to an electrical cable having a plurality of conductors in which at least some of the conductors transmit electrical signals subject to cross talk. In particular, this invention relates to a cable suitable for use in distributing electrical power, data signals suitable for use in control applications and electrical signals suitable for use in telephonic communications.

2. Description of the Prior Art

Standard building and electrical codes require the separation of cables used in the distribution of electrical power and for transmission of signals, such as telephone signals or data signals. Recently, more sophisticated systems have been proposed in which the integrated distribution of power, and signals within a building would provide some significant advances in the wiring in the building. For example, it has been proposed that power, data, control and entertainment cabling be integrated into a single cable, both to provide ease of installation and to advance the capabilities of the wiring. One suggested approach is the use of a closed loop power system in which electrical power is delivered to an outlet receptacle or to a component attached to the wiring system only in response to receipt of certain signal intelligence indicating both the need for the presence of a current and indicating that current can be safely transmitted without shorts or opens. Such a system would require an intelligent controller which must be interconnected by data lines. In order to insure that the additional wiring necessary for such a closed loop system could be easily installed within a structure, it has been suggested that power lines, telephone communication lines, integrated cabling and the control lines used for such a system be incorporated into a single cable. To provide for ease of termination, it has been suggested that such a cable would be generally flat and would include three power conductors, a hot, a neutral and a ground, for carrying 60 Hertz 20 amp and 15 amp RMS current. Five data conductors, consisting of two data lines, two clock lines and data ground, would be employed in the same cable. Four telephone lines suitable for either digital or analog transmission would also be included. In order to insure that the control logic in such a system would be continuously supplied with power, two 12 volt DC lines could also be included in such cable. By using a flat ribbon cable configuration, it would be possible to employ an insulation displacement connector to terminate all of these conductors in one operation. In addition to these conductors, such a cable could also include one or two coaxial cables to provide communications or RF entertainment signals which could not be established using the unshielded conductors in the remainder of the cable.

Installation of these relatively wide ribbon cables in a conventional building structure by a conventional construction technique however, introduces certain complications. For instance, unless the cable is bundled into a circular or oval configuration, it would be necessary to drill oblong holes in the studs of a frame structure to route the conductors in a building, such as a home. However, if the cables are bundled, crosstalk can be introduced between the telephone and the data conductors or between the 60 Hertz power conductors and either the telephone or data lines. Compensation for this crosstalk could be provided by incorporating shielding between varying lines, both signal and power, of such a cable. However, if shielding is provided to permit the bundling or grouping of conductors in a circular or oval arrangement, the cost, rigidity and complexity of the cable is increased. The instant invention provides a means for bundling a cable having each of these different transmission media incorporated into a single flat ribbon cable while at the same time preventing excessive crosstalk in the various signal lines.

Multi-media bundled cable which have been previously proposed, either have not taken the crosstalk into account, or have solved that problem by providing shielding around the plurality of the conductors. For example, U.S. Pat. No. 4,533,790 discloses a cable including power supply, telephone and communications or data conductors. The communication or data conductors comprise coaxial conductors and the power supply conductors are surrounded by a shield. In that cable the separate conductors are grouped into separate circular bundles which are interconnected by webs. In any cable in which discrete conductors are positioned in a circular bundle, termination of the conductors requires separation and orientation of specific conductors. Significant benefits of simple mass termination using insulation displacement contacts are lost for a cable of this configuration.

U.S. Pat. No. 4,149,026 and U.S. Pat. No. 4,217,155 disclose a multi-pair cable having low crosstalk in which the respective conductors are so spaced as to effectively form a balanced compacitive bridge configuration. Thus, a low profile, low crosstalk cable suitable for use in undercarpet wiring applications is provided. Those patents however, do not envision the use of a bundled configuration formed initially from a flat cable containing multiple media connectors, such as data, telephone and power conductors.

U.S. Pat. No. 4,758,536 discloses a cable and connector system for use with flat cable containing a plurality of signal conductors and hot, neutral and ground power supply conductors, all located in the same web. Although this patent clearly shows the advantages to be gained from the use of mass termination insulation displacement contacts with a flat cable with conductors spaced side by side, crosstalk problems in a round bundled cable are not accounted for in this patent.

SUMMARY OF THE INVENTION

A distribution cable for transmitting electrical signals without excessive crosstalk is disclosed A plurality of conductors forming this multiple media cable can be retained within a insulative web. One or more coaxial conductors which may be initially incorporated within this insulative web, provides a distribution of signals for coax applications. In the preferred embodiment of this invention other conductors including data and telephone signal conductors are disposed in surrounding relationship to the coaxial conductors. It has been found that by positioning the coaxial conductors in the center of a bundled cable configuration with the data conductors located on one side of the coaxial conductors and the telephone conductors located on another side of the coaxial conductors, improved crosstalk performance between the data and the telephone conductors can be achieved. In the preferred embodiments of this invention, power supply conductors including hot, neutral and ground conductors are also incorporated into the same insulative web. It has been found that improved crosstalk performance is achieved by also positioning these power supply conductors generally between the data conductors and the telephone conductors. When data to telephone crosstalk, power to data cross talk, and power to telephone crosstalk are considered, the embodiments of the bundled cable depicted herein have been found to provide good crosstalk performance for bundled cable lengths of less than 200 feet.

BRIEF DESCRIPTION OF THE DRAWINGS

FIG. 1 shows that the cables comprising the disclosed embodiments of this invention would thus be suitable for use with conventional wiring installation practices.

FIGS. 2A and 2B are views showing a flat cable having a continuous insulative web surrounding all the conductors of the multi-media cable. FIG. 2A shows an embodiment in which coaxial conductors initially formed part of the cable. FIG. 2B shows the same cable after removal and separation of two coaxial conductors from the insulative web.

FIG. 3A is a cross sectional view showing the preferred orientation of the various conductors within a round cable. FIGS. 3B and 3C show other acceptable orientation of the various conductors.

DETAILED DESCRIPTION OF THE PREFERRED EMBODIMENT

Figure 1:
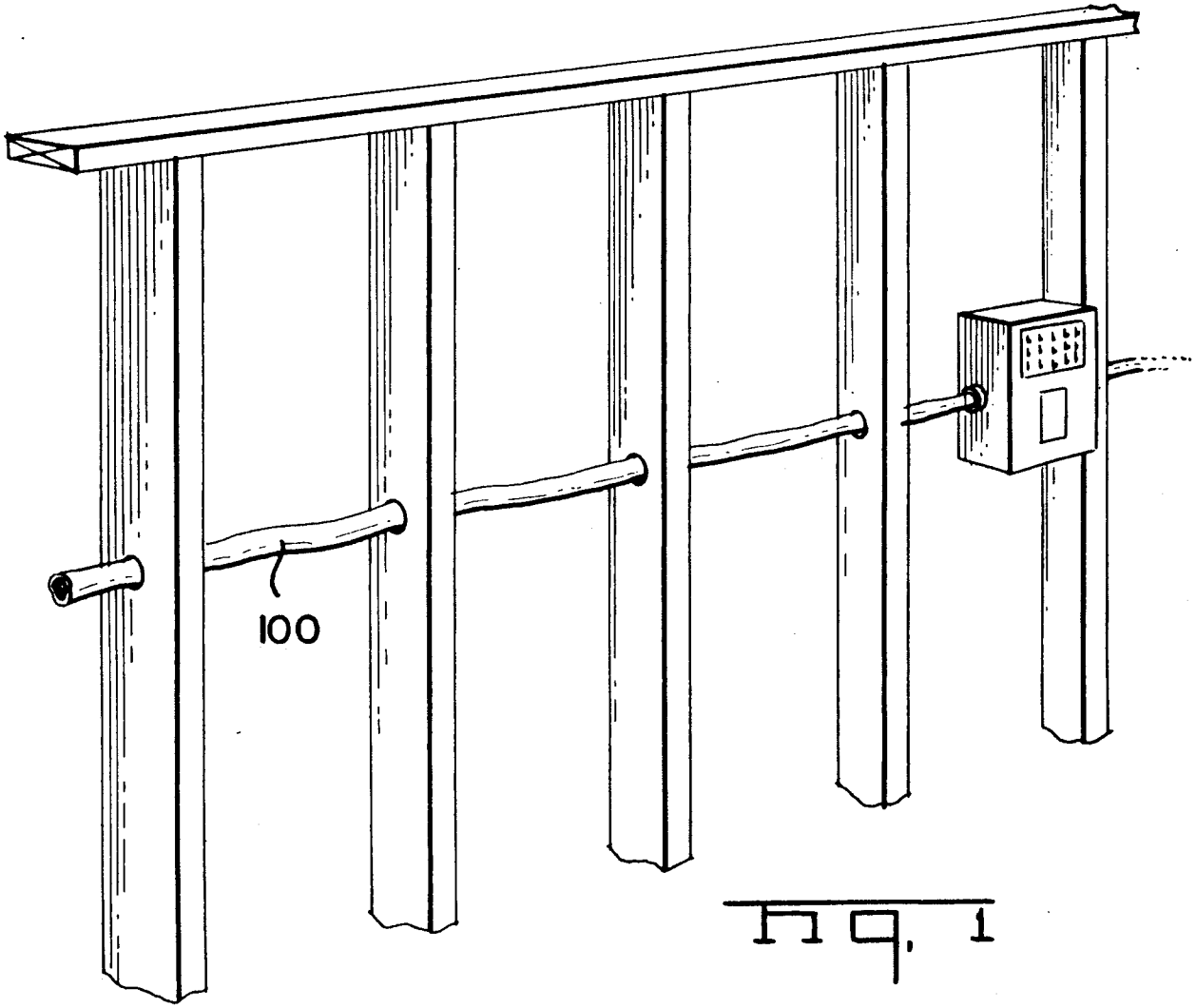
FIG. 1 is an illustrative view showing a bundle of generally round multi-medical cable extending through studs in a frame in accordance with conventional wiring practices.
Figure 1B:
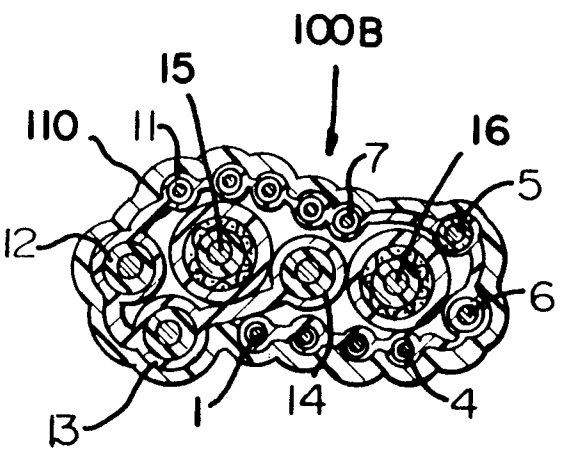
Figure 1C:
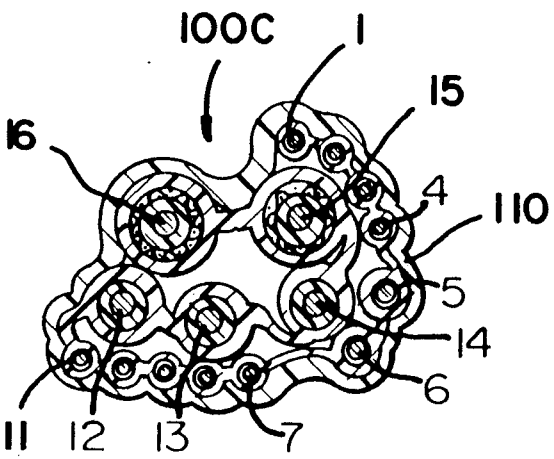
Figure 1A:
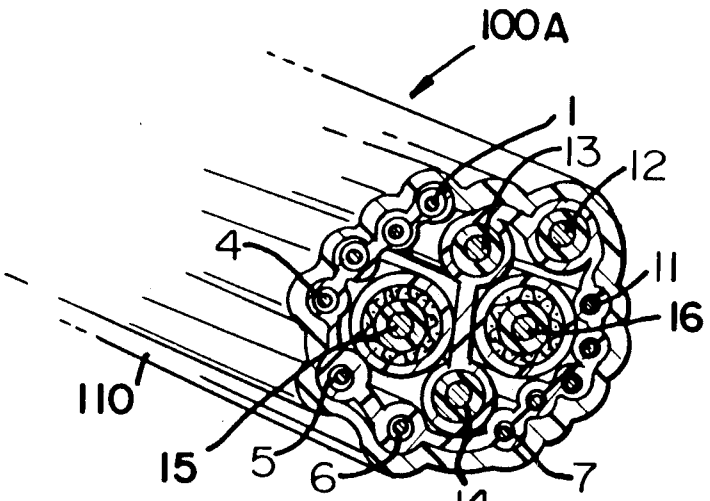

Electrical wiring is conventionally installed within a frame structure by drilling round holes in the studs, the vertically extending members of a frame structure, and then pulling the cable through these holes. FIG. 1 shows the amenability of cable 100 to these conventional wiring practices. These conventional practices are suitable for conventional cables because these conventional cables either have a generally round configuration or only a few conductors are contained within each cable. For example, a normal power supply cable would have only three conductors. Cable 100 is, however, a multi-media cable including power supply conductors, both standard 60 Hertz 15 and 20 amp conductors and separate uninterruptable 12 volt DC power supply conductors. Also included within this cable would be a plurality of telephone conductors and a separate plurality of data conductors. The plurality of separate conductors incorporated in this cable pose two conflicting problems. First, a large number of conductors must be bundled in such a way so that a round cable can be inserted through round holes in the stud using conventional wiring practices. Second, some means must be provided for the efficient termination of this large plurality of conductors without a large number of wiring errors. These problems must be addressed in such a way as to avoid unacceptable crosstalk between the various conductors, especially between telephone conductors and data conductors which carry signals varying a relatively high frequency.

One conventional way of solving the wiring termination problem is to incorporate all or most conductors into a flat web which is keyed in such a manner that correspondingly keyed connectors terminate cable only in the proper fashion. For example, the exterior of the present cable is asymmetric. However, flat cable of this type would be inconsistent with conventional wiring practices.

The cable 100 comprising the preferred embodiment of this invention, constitutes a bundled cable in which a plurality of conductors contained within a common flat insulative web are configured to reduce the crosstalk between the various conductors to an acceptable level.

Bundled cable 100 can be formed using an initially flat cable 102. This initially flat cable can contain 16 separate conductors all embedded within a common extruded insulative web formed of a material such as polyvinyl chloride. Indeed this cable can be formed by extruding a common insulative web 104 around the individual conductors, each of which may even have a separate insulative coating around the individual conductors. Indeed this separative insulative coating around the individual conductors might even be color coded. The following table lists the individual conductors 1–16 which would be employed in this cable 100 and shows a color coding scheme for the various conductors.

| | | |
|---|---|---|
| 1 - Telephone Line #1 | Black | 24 Gauge |
| 2 - Telephone Line #1 | Red | 24 Gauge |
| 3 - Telephone Line #2 | Green | 24 Gauge |
| 4 - Telephone Line #2 | Yellow | 24 Gauge |
| 5 - +12 Volts D.C. | Black | 18 Gauge |
| 6 - −12 Volts D.C. | White | 18 Gauge |
| 7 - Data #1 | Purple | 24 Gauge |
| 8 - Data #2 | Brown | 24 Gauge |
| 9 - Data Ground | Green/Yellow Stripes | 24 Gauge |
| 10 - Clock #1 | Brown | 24 Gauge |
| 11 - Clock #2 | Orange | 24 Gauge |
| 12 - Power Neutral | White | 12 or 14 Gauge |
| 13 - Power Ground | Green | 12 or 14 Gauge |
| 14 - Power Hot | Black | 12 or 14 Gauge |
| 15 - Coax #1 | White | N/A |
| 16 - Coax #2 | Black | N/A |

The flat cable configuration shown in FIG. 2 does provide mass termination advantages for conductors which can employ an insulation displacement type contact. However, acceptable mass termination contacts for coaxial cables are not available. Therefore, the incorporation of the coaxial cable into the flat insulative web 104 is unnecessary for termination. The conventional crimp terminations are more suitable for coaxial conductors.

FIGS. 3A and 3, 3B and 3C show three bundled or round cable configurations, 100A, 100B and 100C respectively. Analysis of these configurations has shown that each configuration provides good, acceptable crosstalk performance between telephone and data, between 60 Hertz power and data, and between 60 Hertz power and telephone. In each of these configurations the coaxial cable is generally positioned between the array of telephone conductors 1–4 and the array of data conductors 7–11. As an example for data and telephone signals comprising a 5 volt square wave with 20 nanosecond rise and fall times and a 2.86 microsecond period that the attenuation between conductors (dB)

down for the configurations of FIGS. 3A through 3C would be as follows:

| | Data to telephone (dB) | AC power to telephone (dB) | AC power to data (dB) |
|---|---|---|---|
| FIG. 3A | 41 | 85 | 75 |
| FIG. 3B | 39 | 82 | 76 |
| FIG. 3C | 58 | 81 | 91 |

These levels of crosstalk have been found acceptable for distribution of power, data and telephone signals in a multi-media residential wiring environment.

FIG. 3A shows a cable 100A in which both the power ground conductor 13 and the power hot conductor 14 are positioned between two coaxial cables 15 and 16. Coaxial cables 15 and 16 are separate from the remainder of the flat cable 102. Flat cable 102 is wrapped around the coax conductors 15 and 16 so that the bundled cable has a continuous cross section with the data conductors 7–11 being located on one side of the coaxial conductors 15 and 16 and the telephone conductors 1–4 being located generally along the other side. The flat cable 102 is held in this configuration by an insulative sheath or jacket 10 which in the preferred embodiment of this invention is extruded around the bundled cable configuration.

A slightly different embodiment of this invention is shown in FIG. 3B. The cable 100B shown in FIG. 3B also has the flat cable 102 extending around two separate coaxial conductors 15 and 16. In this embodiment the hot power conductor 14 is located directly between the two side by side coaxial conductors 15 and 16. Note, however, that the telephone conductors 1–4 are on the opposite side of the coaxial conductors 15 and 16 from the data conductors 7–11.

The third embodiment of this invention is shown in FIG. 3C. This flat folded figure configuration is formed using a flat cable in which coaxial conductors 15 and 16 remain attached to the insulative web containing 1–14. In this configuration none of the power conductors are located between the two coaxial conductors 15 and 16. However, the telephone conductors 1–4 and the data conductors 7–11 are still generally on opposite sides of the coaxial conductors 15 and 16. It should be noted that in each of these three embodiments that the power conductors 12–14 and 5 and 6 are located generally along the center line of the bundled cable configuration. Note that signal variation in these conductors tends to be less than that of the telephone conductors and the data conductors.

Figure 4:
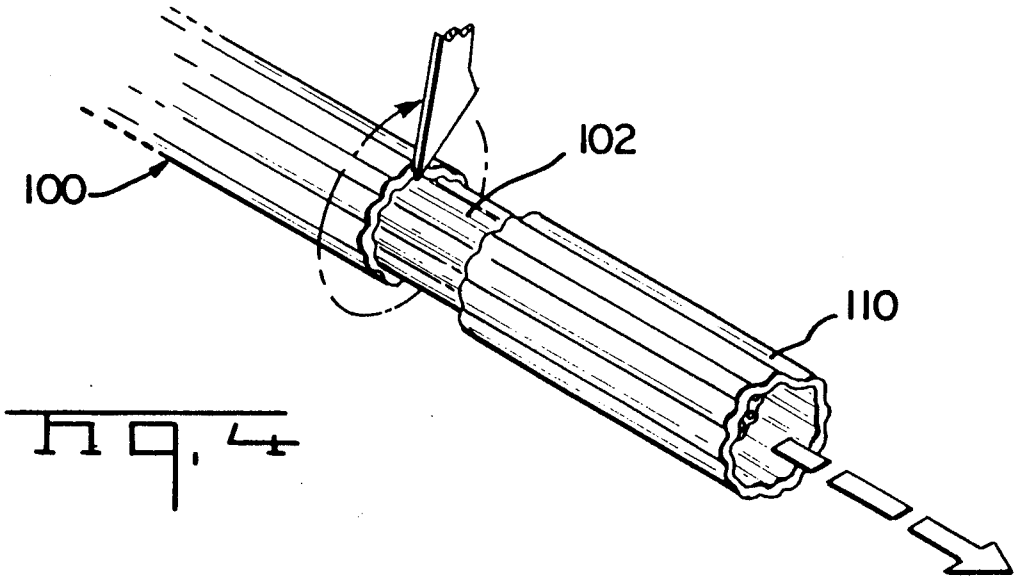
FIG. 4 is a view showing the removal of the outer sheath.
Figure 5:
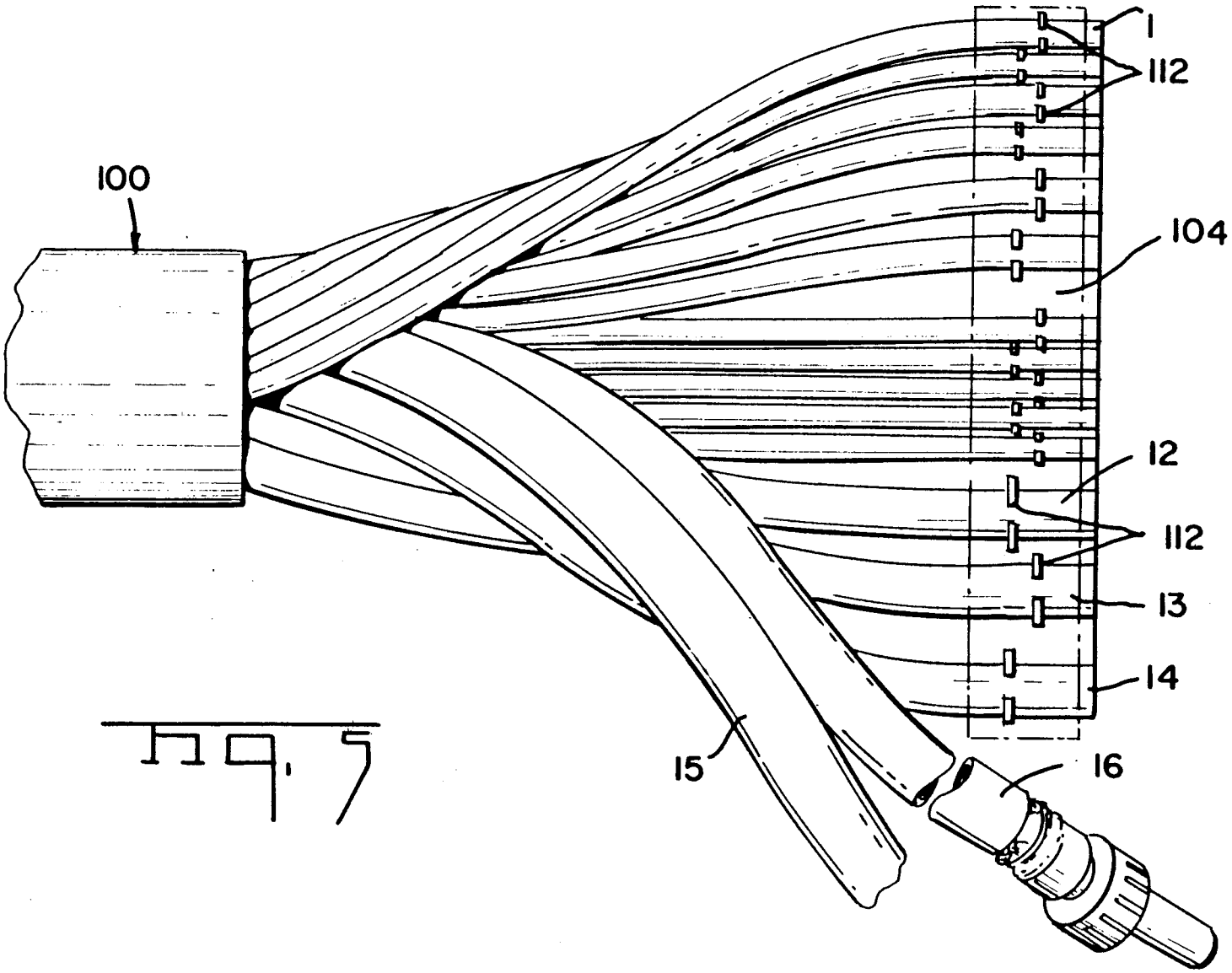
FIG. 5 illustrates the manner in which all of the conductors, other than the two coaxial conductors, may be deployed for simple mass termination using insulation displacement contacts.

FIG. 5 illustrates the manner in which the bundled cable configuration of FIG. 3A can be d so that conductors 1–14, as part of insulative web 104 be deployed for simple mass termination by a plurality of slotted plate terminals 112 oriented to make contact with the respective conductors. A separate crimp termination could be made to coaxial conductors 15 and 16. As shown, in FIG. 4, all of the conductors become accessible after the sheath or jacket 110 has been removed near the end of the cable. Individual conductors 1–14 in the flat cable 102 can now be mass terminated by simply forcing the conductors into corresponding insulation displacement terminals 112.

All of the preferred embodiments of this invention depicted herein show the use of telephone, data, power and two coaxial conductors. It should be understood that this invention can be used with other embodiments having different conductor configurations. Although slightly different orientations of the conductors relative to the coaxial cables would be possible, even as FIGS. 3A, 3B and 3C differ, this invention anticipates the positioning of the telephone conductors and data conductors, in other words the two separate signal conducting media, on opposite sides of the central coaxial conductors. This invention, is not, however, limited to a configuration containing two coaxial conductors. For example, a closed loop system with only a single coaxial conductor might be used. The bundled cable configuration comprising this invention however, would still be applicable to a configuration having one rather than two coaxial conductors located between separate groups of signal conductors.

We claim:

1. A distribution cable for transmitting electrical signals without excessive crosstalk, comprising at least one coaxial signal conductor having a braid surrounding a center conductor;

at least one first unshielded signal conductor;

at least one second unshielded signal conductor, each at least one said first and second unshielded signal conductor extending parallel to the at least one coaxial conductor, where said at least one first unshielded signal conductor is disposed on the opposite side of the at least one coaxial conductor from the at least one second unshielded signal conductor, and said at least one first unshielded signal conductor and the at least one second unshielded signal conductor are disposed in a common insulative web, the insulative web being wrapped at least partially around the at least one coaxial conductor; and an insulative sheath surrounding said insulative web to retain the at least one first unshielded and at least one second unshielded signal conductor on opposite sides of the at least one coaxial conductor, so that crosstalk between the at least one first unshielded signal conductor and the at least one second unshielded signal conductor is reduced by the braid of the at least one coaxial conductor.

2. The distribution cable of claim 1 further comprising a plurality of power conductors disposed at least partially between the at least one first and second signal conductors, the power conductors being disposed in the common insulative web.

3. The distribution cable of claim 2 including two coaxial conductors wherein a portion of the insulative web between two of the power conductors extends between the two coaxial conductors.

4. The distribution cable of claim 1 wherein the at least one first unshielded signal conductor comprises a plurality of conductors of the type suitable for the transmission of digital signals.

5. The distribution cable of claim 4 wherein the at least one second unshielded signal conductor comprises a plurality of conductors of the type suitable for the transmission of analog signals.

6. The distribution cable of claim 5 wherein the second unshielded conductors comprise conductors for the transmission of telephone signals.

7. The distribution cable of claim 6 further comprising a plurality of first power conductors and a plurality of second power conductors.

8. The distribution cable of claim 7 wherein the power and unshielded signal conductors are disposed within common insulative web, the first power conductors being disposed adjacent one end of the common insulative web, the second power conductors being disposed between the first unshielded signal conductors and the second unshielded signal conductors.

9. An electric cable comprising a plurality of unshielded conductors for transmitting a plurality of signals at frequencies sufficient to induce crosstalk between unshielded conductors, the cable comprising an initially planar insulative web containing the unshielded conductors in side by side relationship, the insulative web being wrapped around at least one coaxial signal conductor having a braid surrounding a center conductor, so that unshielded conductors on one side of the at least one coaxial conductor are shielded from unshielded conductors on the other side of the at least one coaxial conductor by the braid of the at least one coaxial conductor to reduce crosstalk therebetween.

* * * * *